US007419367B2

(12) United States Patent
Rijnberg

(10) Patent No.: US 7,419,367 B2
(45) Date of Patent: Sep. 2, 2008

(54) MAGNETICALLY ACTUATED PUMP

(76) Inventor: Frans Lodewijk Rijnberg, 35, Laan van Nieuw Oosteinde, 2274 EA Voorburg (NL)

( * ) Notice: Subject to any disclaimer, the term of this patent is extended or adjusted under 35 U.S.C. 154(b) by 523 days.

(21) Appl. No.: 10/484,483

(22) PCT Filed: Jul. 17, 2002

(86) PCT No.: PCT/NL02/00479

§ 371 (c)(1),
(2), (4) Date: Jan. 16, 2004

(87) PCT Pub. No.: WO03/008804

PCT Pub. Date: Jan. 30, 2003

(65) Prior Publication Data

US 2004/0219041 A1 Nov. 4, 2004

(30) Foreign Application Priority Data

Jul. 17, 2001 (NL) ..... 1018567

(51) Int. Cl.
*F04B 17/04* (2006.01)

(52) U.S. Cl. ..... 417/416; 417/505; 417/418

(58) Field of Classification Search ..... 417/416, 417/417, 388, 418, 322, 211, 410.1, 505
See application file for complete search history.

(56) References Cited

U.S. PATENT DOCUMENTS 2,765,747 A 10/1956 Aumick et al.
2,796,026 A * 6/1957 Hooker, Jr. ..... 417/388
4,131,398 A 12/1978 Rocchitelli
4,815,946 A 3/1989 Cusack
5,346,369 A 9/1994 Miller, Jr.

FOREIGN PATENT DOCUMENTS

WO WO 03/008804 A3 1/2003

* cited by examiner

*Primary Examiner*—Devon Kramer
*Assistant Examiner*—Vikansha Dwivedi
(74) *Attorney, Agent, or Firm*—Hoffman & Baron, LLP

(57) ABSTRACT

A pump for pumping one or more media comprises a housing (1) having an actuator chamber (2) and at least one pump chamber (4). The pump chamber (4) is provided with an inlet port and an outlet port. The pump chamber (4) is delimited by a displacement member (5) which is movable to and fro between a first position and a second position. The pump further comprises a movable actuator body (3), accommodated in the actuator chamber (2) and consisting of a magnetizable or magnetic material, for driving the displacement member (5). The pump also comprises magnetic drive means (8*a*, 8*b*) for creating a magnetic field in order to move the actuator body (3). The actuator body (3) is freely movable relative to the displacement member (5) so that the displacement member (5) can be moved, by means of an impact motion of the actuator body (3), from the first to the second position.

11 Claims, 8 Drawing Sheets

MAGNETICALLY ACTUATED PUMP

CROSS-REFERENCE TO RELATED APPLICATIONS

This application is the national stage filing under 35 U.S.C. §371 of PCT/NL02/00479, filed Jul. 17, 2002, which claims priority to NL 1018567, filed Jul. 17, 2001, which is incorporated herein by reference.

A first aspect of the invention relates to a pump for pumping one or more media, comprising:

- a housing having an actuator chamber and at least one pump chamber, which is provided with an inlet port and an outlet port and which is delimited by a displacement member which is movable to and fro between a first position, in which the pump chamber has a maximum volume, and a second position, in which the pump chamber has a minimum volume,
- a movable actuator body, accommodated in the actuator chamber and consisting of a magnetizable or magnetic material, for driving the displacement member,
- magnetic drive means for creating a magnetic field in order to move the actuator body.

In U.S. Pat. No. 5,055,011 a pump is disclosed which is provided with an electromagnet and a cylinder in which a piston is accommodated as the displacement member. The piston is provided with a magnetic element. As a result of the magnetic element accommodated therein, the piston can be moved in the cylinder by excitation of the electromagnet.

OBJECTS OF THE INVENTION

The object of the invention is to provide an improved pump.

SUMMARY OF THE INVENTION

To this end, the first aspect of the invention provides a pump according to the preamble of claim 1, in which the actuator body is freely movable relative to the displacement member so that the displacement member can be moved, by means of a impact motion of the actuator body, from the first to the second position.

With the magnetic drive means, a magnetic field can be generated in the actuator chamber. The magnetic field can be applied such that the actuator body is accelerated in the direction of the at least one pump chamber. The actuator body then impacts against the displacement member. Under the influence of the mass and velocity of the actuator body, the displacement member is moved from the first to the second position so that the volume of the pump chamber is diminished and the medium to be pumped is pumped away through the outlet port of the pump chamber.

Preferably, electromagnetic drive means are used as the magnetic drive means. The electrical energy required to excite the electromagnetic drive means is converted into kinetic energy by the actuator body. The kinetic energy is used to provide the energy for effecting the pump stroke of the displacement member in the pump chamber. Through continued excitation of the electromagnet during the pump stroke, the electromagnet also continues to supply energy to effect the pump stroke.

In a preferred embodiment, the pump has two or more pump chambers, the displacement member of each separate pump chamber being able to be impacted against by the common actuator body. It is thus possible to impact against the displacement members of the pump chambers alternately with the same actuator body. One advantage of this is that a medium can be pumped in a simple manner for each pump chamber, using a single actuator body.

Preferably, the actuator body is movable from the one pump chamber to the other pump chamber. By directing the actuator body from the one pump chamber to the other pump chamber, a multiple pump mechanism is obtained, in which the energy is very efficiently used for the pumping of media. Furthermore, by pumping a different medium for each pump chamber, the pump according to the invention can be used as a metering pump, that quantity of a medium which is to be metered being determined by the number of impacts multiplied by the pump chamber volume and being easy to regulate.

In a further embodiment, the electromagnetic drive means comprise electromagnets fitted alongside the separate pump chambers. This configuration enables the actuator body to be easily repelled by an electromagnet belonging to a pump chamber and attracted, for example, by an electromagnet belonging to another pump chamber.

A second aspect of the invention relates to a pump. The pump according to this second aspect is provided with electromagnetic drive means for creating a magnetic field in order to move the actuator body and has a pump chamber which, at the inlet and/or outlet port, is provided with a magnetically operable valve which is operated by a magnetic field generated by the electromagnetic drive means, belonging to the pump chamber, for driving the actuator body.

It will be clear that the first aspect and the second aspect of the invention can also be used in combination.

BRIEF DESCRIPTION OF THE DRAWINGS

Further embodiments and advantages of the invention will be explained with reference to the drawing, in which.

DETAILED DESCRIPTION OF THE INVENTION

Figure 1:
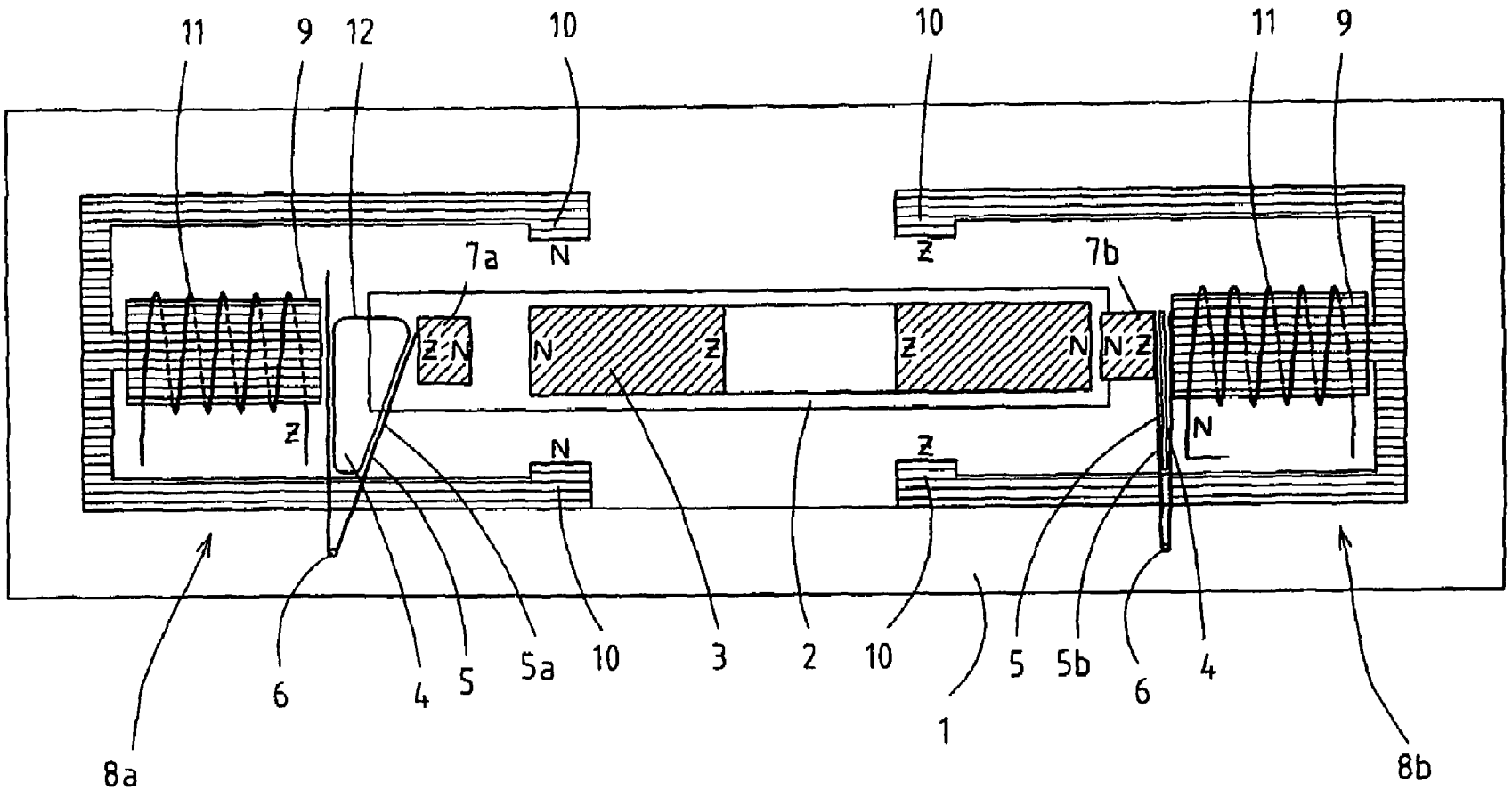
FIG. 1 shows a diagrammatic view in cross section of an embodiment of a pump according to the invention.

FIG. 1 shows a housing 1 having pump chambers 4 and an actuator chamber 2. The pump chamber 4 has a movable wall 5, which at 6 is hinge-connected to the housing 1. The movable wall 5 is on one side of the housing more precisely denoted by 5*a* and reproduces a first position, in which the pump chamber 4 has the maximum volume. On the opposite side, the movable wall 5 is denoted by 5*b* and represents the second position, in which the pump chamber 4 has the minimum volume. The movable wall 5 serves as a displacement member. Attached to the movable wall 5 is a permanent magnet 7.

In the actuator chamber 2 there is accommodated a single actuator body 3. In this example, the actuator body 3 is realized as a permanent magnet, which is realized as a sliding body. In the example shown, the north pole of the actuator body 3 is situated at the outermost ends of the actuator body 3 and denoted by N. The south pole of the actuator body 3 is situated on the inner edge and is denoted by Z.

In addition, in the housing 1, electromagnets 8*a*, 8*b* are fitted. The electromagnets 8*a*, 8*b* have a soft iron core 9 with, round about it, a winding 11. The soft iron core 9 is connected to the arms 10. The field lines of the electromagnets 8*a*, 8*b* shown result in a force which is directed parallel to the plane of motion of the actuator body 3.

The actuator body 3 and the magnet 7*a*, 7*b* of the movable wall 5 are oppositely polarized. As can be seen in FIG. 1, in this illustrative embodiment that side of the magnet 7*a*, 7*b* which faces the actuator body 3 is the magnetic north pole, denoted by N. The magnet 7*a*, 7*b* of the movable wall 5 will thus always repel the actuator body 3. It is also possible to polarize the magnet 7*a*, 7*b* in the same direction as the actuator body 3, so that the movable wall 5 will attract the actuator body 3.

When the electromagnets 8*a*, 8*b* are not excited, the magnet 7*a*, 7*b* will always be attracted by the soft iron core.

By excitation of the electromagnets 8*a*, 8*b*, the actuator body 3 can be attracted or repelled. In FIG. 1, a situation is represented in which the actuator body 3 is located alongside a pump chamber 4 and its associated electromagnet 8*b*. The electromagnet 8*b* is now excited such that it repels the actuator body 3. At the same time, the electromagnet 8*a* is excited such that it attracts the actuator body 3. By virtue of the resultant force of the magnetic field generated by the electromagnets 8*a*, 8*b*, the actuator body 3 is accelerated from the electromagnet 8*b* in the direction of the electromagnet 8*a*. The pump chamber which is located there has the movable wall 5 in the first position, that is to say has the maximum volume.

By virtue of its velocity and mass, the actuator body 3 moving towards the pump chamber 4 will push the movable wall 5 from the first to the second position, whereby the volume of the pump chamber 4 is reduced. A medium present in the pump chamber 4 will consequently be pumped via the outlet port (not shown in this figure) out of the pump chamber 4.

The motion of the actuator body 3 is somewhat dampened close to the movable wall 5 by the repellant effect of the oppositely polarized magnet 7*a*.

If, in a non-illustrated alternative, the magnet 7*a*, 7*b* is polarized in line with the actuator body 3, then whenever the actuator body 3 is repelled by an electromagnet 8, the displacement member (the wall 5) is repelled by the same electromagnet 8 and taken along by the actuator body 3. The displacement member is then moved from the second to the first position.

The wall 5 with magnet 7*b* remains in the second position as a result of the attraction force of the electromagnet 8*b*. When the electromagnet 8*b*, in a following excitation, is excited the other way round in order thereby to attract the actuator body 3, the electromagnet 8*b* will also repel the magnet 7*b*, whereby the movable wall 5*b* is moved from the second to the first position. The volume of the pump chamber 4 is enlarged and medium will be drawn via an inlet port (not shown) into the pump chamber 4. The magnets 7*a* and 7*b* thus act as resetting means for the displacement member, which is here realized as the movable walls 5*a*, 5*b*.

It is also possible to make the movable wall 5*a*, 5*b* itself out of a magnetic or magnetizable material, so that the wall 5*a*, 5*b* itself reacts to the magnetic field generated by the neighbouring electromagnet.

Good functioning of the pump can also be obtained by providing each movable wall 5, instead of with the magnet 7*a*, 7*b*, with a spring (not shown). The spring pushes the movable wall 5 back from the second position to the first position after the actuator body 3 has been removed from the movable wall 5. The movable wall 5 can also itself be realized as a spring, for example a leaf spring.

Figure 10:
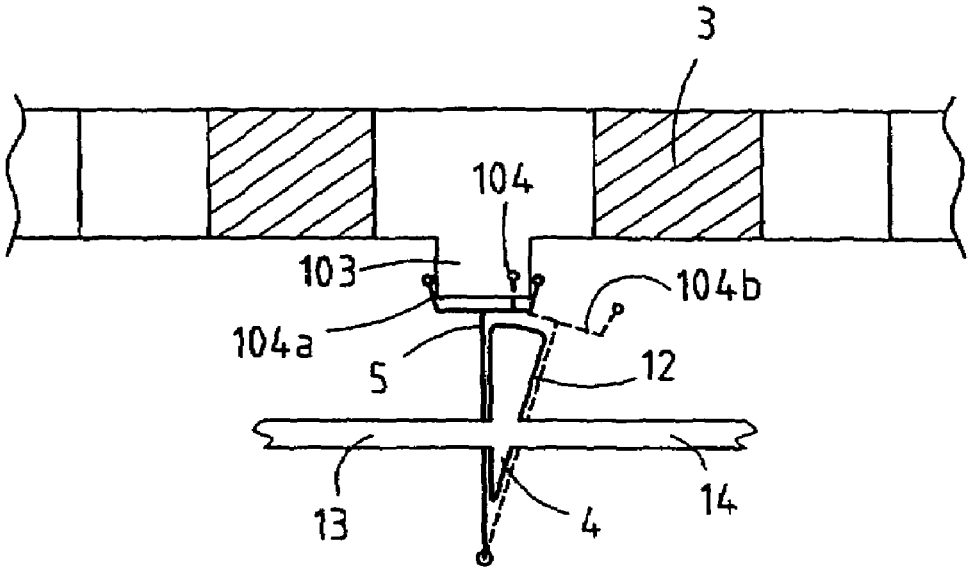
FIG. 10 shows an alternative embodiment of an actuator body of a pump according to the invention.

Another possible embodiment is shown in FIG. 10. In this case, the pump chamber 4 is situated below or above the actuator chamber. The actuator body 3 is provided with a cam 103. The free end of the movable wall 5 is provided with a protruding ring 104. When the actuator body moves up to the chamber 4, then the movable wall 5 stands obliquely (represented by a dotted line and denoted by 104*b*). The cam 103 enters the ring 104 substantially in the radial direction thereof, impacts against the ring and takes this along with it in its direction of motion. The cam 103 is then located in the ring 104. When the movable wall 5 comes into the second position (represented with a continuous line and denoted by 104*a*), it will be unable to move any further. When the actuator body 3 is moved away from the pump chamber 4, then the cam 103 located in the ring 104 takes along the movable wall 5 in its motion from the second position to the first position, whereupon the pump chamber volume is enlarged. The movable wall 5 tilts, whereby the ring 104 also tilts to the point where the cam 103 is able to move back out of the ring 104.

Figure 3:
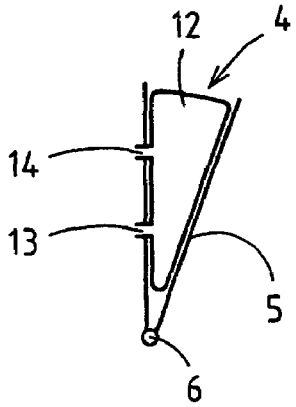
FIG. 3 shows an embodiment of a pump chamber of a pump according to the invention.

In the pump chamber 4 a liquidtight bellows 12 can be fitted, as shown in FIG. 3. This bellows 12 is connected to an inlet port 13 and an outlet port 14 of the pump chamber 4. Through the use of the bellows 12, a liquidtight circuit is obtained and no further sealing of the pump chamber 4 is necessary, especially with respect to the actuator chamber 2.

Figure 11:
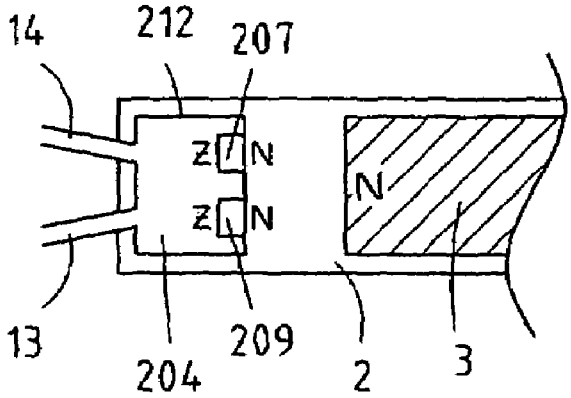
FIG. 11 shows an alternative embodiment of a pump chamber of a pump according to the invention.

It is also possible to fit a liquidtight bellows with which there is no movable wall but with which the bellows are impacted against directly by the actuator body. This is represented in FIG. 11. The bellows 212 is located in the actuator chamber 2 and forms, in fact, a pump chamber 204. The wall of the bellows 212 acts as a displacement member and is provided, on the side facing the actuator body 3, with magnetic elements 207, which are polarized oppositely to the actuator body and have the same function as the magnets 7*a*, 7*b* in the example of FIG. 1, that is to say they act as resetting means.

Figure 4:
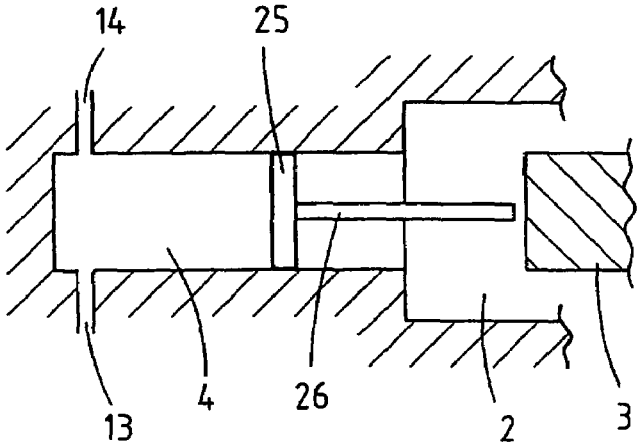
FIG. 4 shows another embodiment of a pump chamber of a pump according to the invention.

The pump chamber 4 can also be realized differently, as represented in FIG. 4. The pump chamber 4 is realized as a cylinder in which a piston 25 can be moved to and fro. The inlet port and outlet port of the pump chamber are denoted by 13 and 14 respectively. In the case shown, the piston 25 has a piston rod 26. This piston rod 26 can extend into the actuator chamber 2 and can be impacted against by the actuator body 3.

Figure 5:
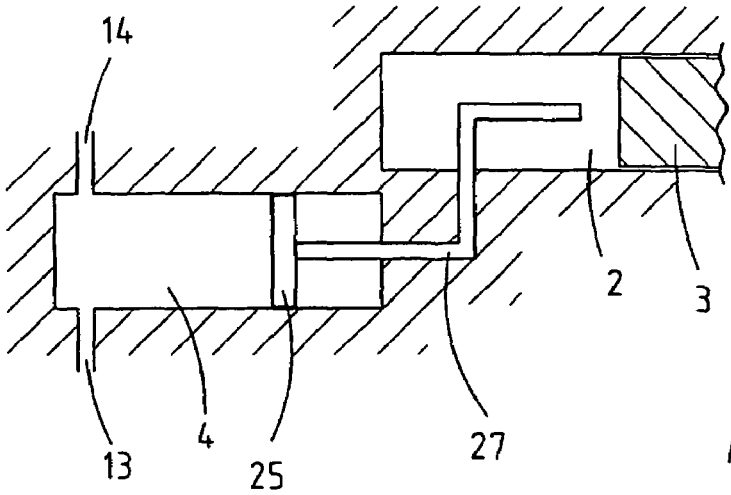
FIG. 5 shows yet another embodiment of a pump chamber of a pump according to the invention.

In connection with possible damage to the media to be pumped, caused by the magnetic fields of the electromagnets, it may be desirable, for example, for the pump chamber 4 to be distanced from the actuator chamber 2, as shown in FIG. 5. In this illustrative embodiment, a system of rods 27 forms a transmission, which transmits the impact motion of the actuator body 3 to the piston 25, but it is clear that other transmissions are also conceivable.

Figure 8:
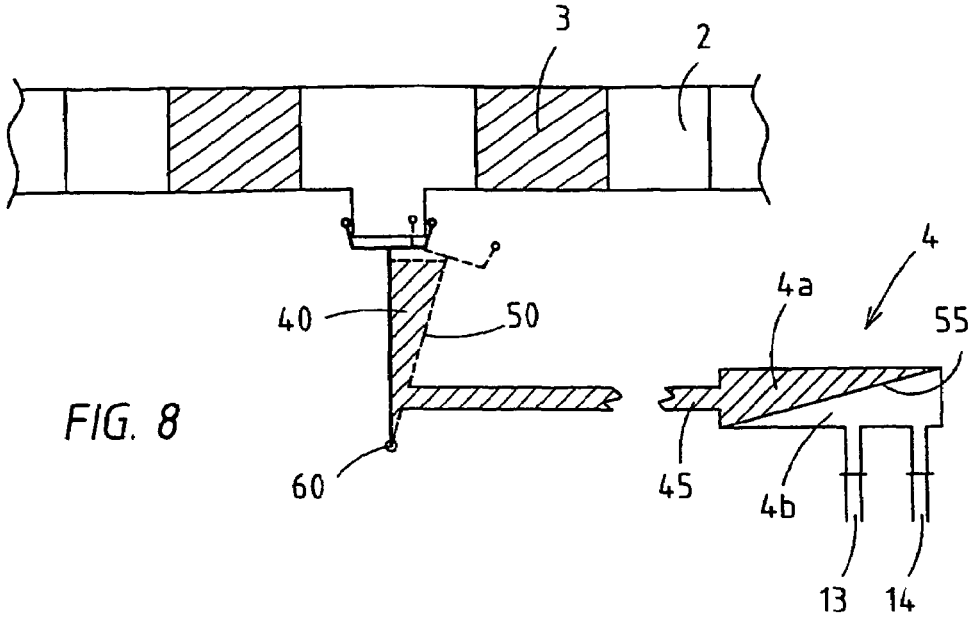
FIG. 8 shows an embodiment of the pump having a hydraulic transmission between the actuator body and the displacement member.

The pump chamber 4 can also be distanced from the actuator chamber 2 through the use of a hydraulic transmission, as shown in FIG. 8. In this case, a first chamber 40 filled with hydraulic fluid is diminished in volume by a movable wall 50 being rotated about a hinge 60 by means of the impact of the actuator body 3. The hydraulic fluid is pumped via a pipe 45 to a subchamber 4*a* of the pump chamber 4. The subchamber 4*a* of the pump chamber 4 is separated by a flexible membrane 55 from a subchamber 4*b* containing the medium to be pumped. When the subchamber 4*a* is filled with hydraulic fluid, then the membrane 55 deforms and the medium to be pumped is forced out into the subchamber 4*b* and pumped away. In this example, the membrane 55 acts as the displacement member.

Figure 2A:
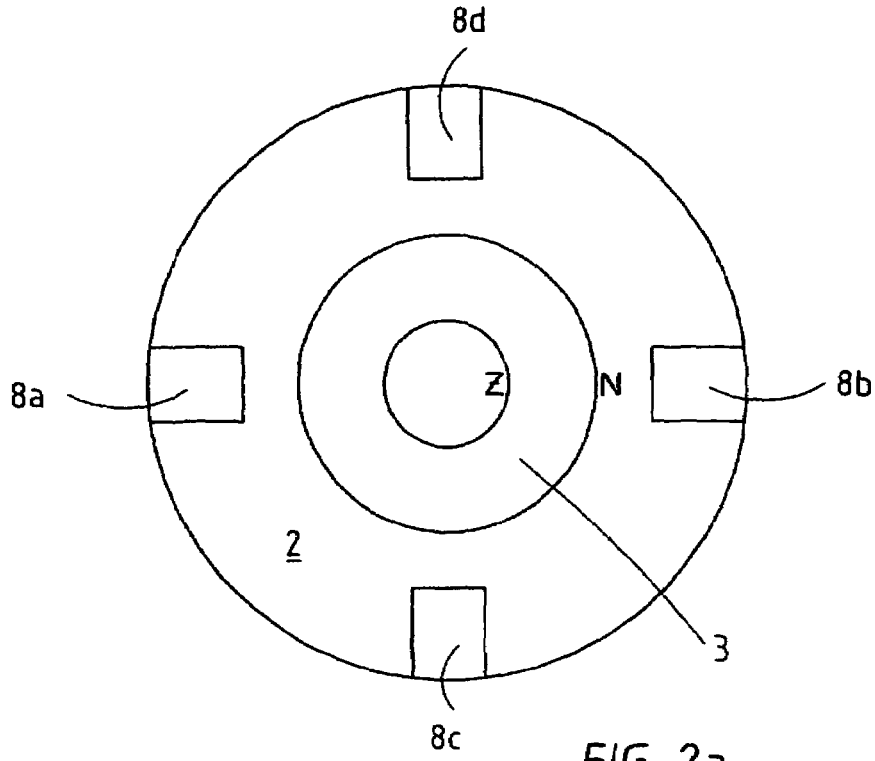
FIG. 2*a* shows a top view of an actuator chamber of a pump according to the invention with the actuator body in the middle position.

In FIG. 2*a* the actuator chamber 2 is represented with the actuator body 3 therein, the latter being realized as a radially polarized annular magnet. The actuator body 3 could also be realized as a disc-shaped magnet. Four electromagnets 8*a* to 8*d* are placed in diametrically opposing pairs round about the actuator chamber 2. The actuator body 3 has in an associated plane of motion two degrees of freedom and can be directed to any desired position in the actuator chamber 2. In the position shown in FIG. 2*a*, the actuator body 3 is in the central position. This position can be maintained, for example, by exciting the electromagnets 8*a* to 8*d* in such a way that they repel the actuator body 3 with equal force.

Figure 2B:
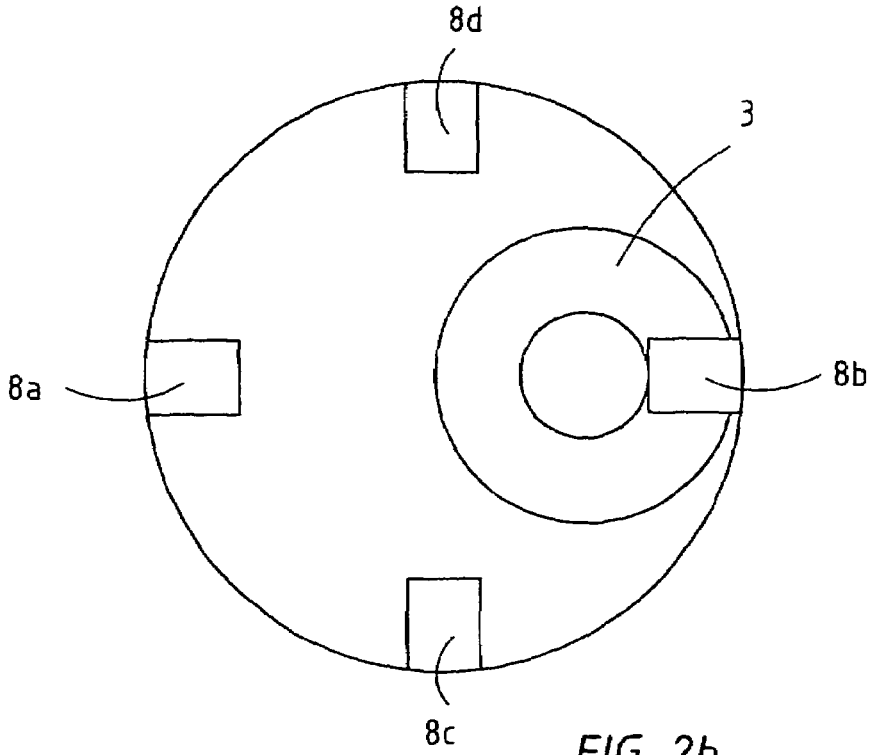
FIG. 2*b* shows the actuator chamber of FIG. 2*a* with the actuator body in another position.

In FIG. 2*b* the actuator body 3 is represented in the position in which the pump chamber 4 belonging to the electromagnet 8*b* is served. From this position, the electromagnets 8*a* to 8*d* can be excited in such a way that a magnetic field moves the actuator body 3 to the opposite pump chamber 4 alongside the electromagnet 8*a*. It is also possible to make the actuator body 3 move to one of the other pump chambers belonging to the electromagnets 8*c*, 8*d*. This might be done in a direct motion, that is to say in a straight line, but this might also be done, if required, via the middle position shown in FIG. 2*a*, in order to obtain a sufficiently large velocity component in accordance with the direction of motion of the displacement member in the pump chamber 4 to be able to transfer sufficient kinetic energy to that displacement member.

The actuator chamber 2 can be filled with a fluid having approximately the same specific weight as the actuator body 3. The actuator body 3 can consequently be moved through the actuator chamber 2 with virtually no friction.

The filling of the actuator chamber 2 with the fluid also offers the possibility of making the actuator body 3 perform three-dimensional motions within the actuator chamber 2, independently of the gravitational force.

If the actuator chamber 2 is filled with a fluid, then an underpressure can arise at the moment when the volume of the actuator chamber 3 is enlarged by the reduction in the volume of the adjacent pump chamber. This can be compensated for by fitting in the actuator chamber 3 an air chamber in open connection with the environment, the air chamber increasing in volume whenever an underpressure is present in the actuator chamber 3. The volume increase is thereby compensated for and the underpressure abates.

With the embodiment shown in FIGS. 2*a* and 2*b*, a plurality of media, for example, could be pumped. It is also possible to use the pump as a metering pump. This can be done by making the different pump chambers 4 pump different media and by operating the displacement members of these pump chambers 4 in a certain order and in a certain number of pump motions. For instance, different media which have thus been controlled can be pumped and metered to form a desired mixture of these media. The number of pump chambers 4 and associated electromagnets is not, of course, limited to four. More pump chambers 4 can also be fitted around the actuator chamber 2. Given constant dimensions of the pump chambers and associated electromagnets, this number is only limited, in fact, by the dimensions of the actuator chamber 3.

Figure 6A:
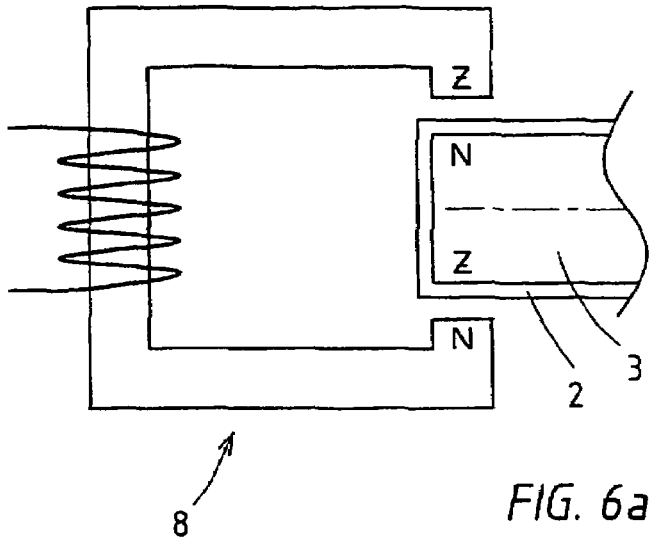
FIG. 6*a* shows an alternative embodiment of an electromagnet of the pump according to the invention.

In the previous illustrative embodiment the annular magnet is radially magnetized, but the actuator body 3 can also be realized as an axially magnetized ring or disc, as represented diagrammatically in FIG. 6*a*. The electromagnets 8*a* to 8*d* must then generate a field which is perpendicular to the direction of motion of the actuator body 3 in the actuator chamber 2.

Figure 6B:
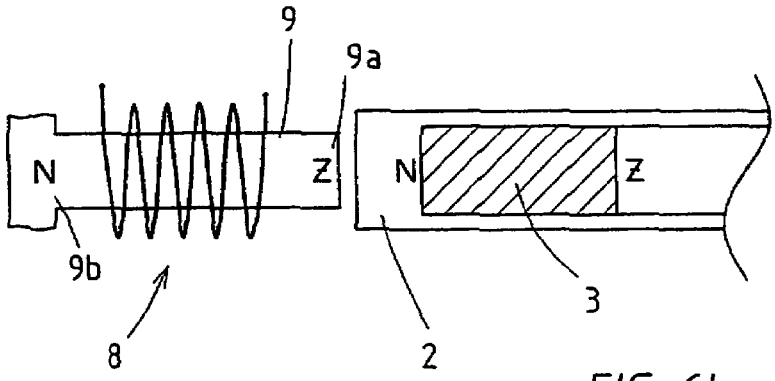
FIG. 6*b* shows another alternative embodiment of an electromagnet of the pump according to the invention.
Figure 9:
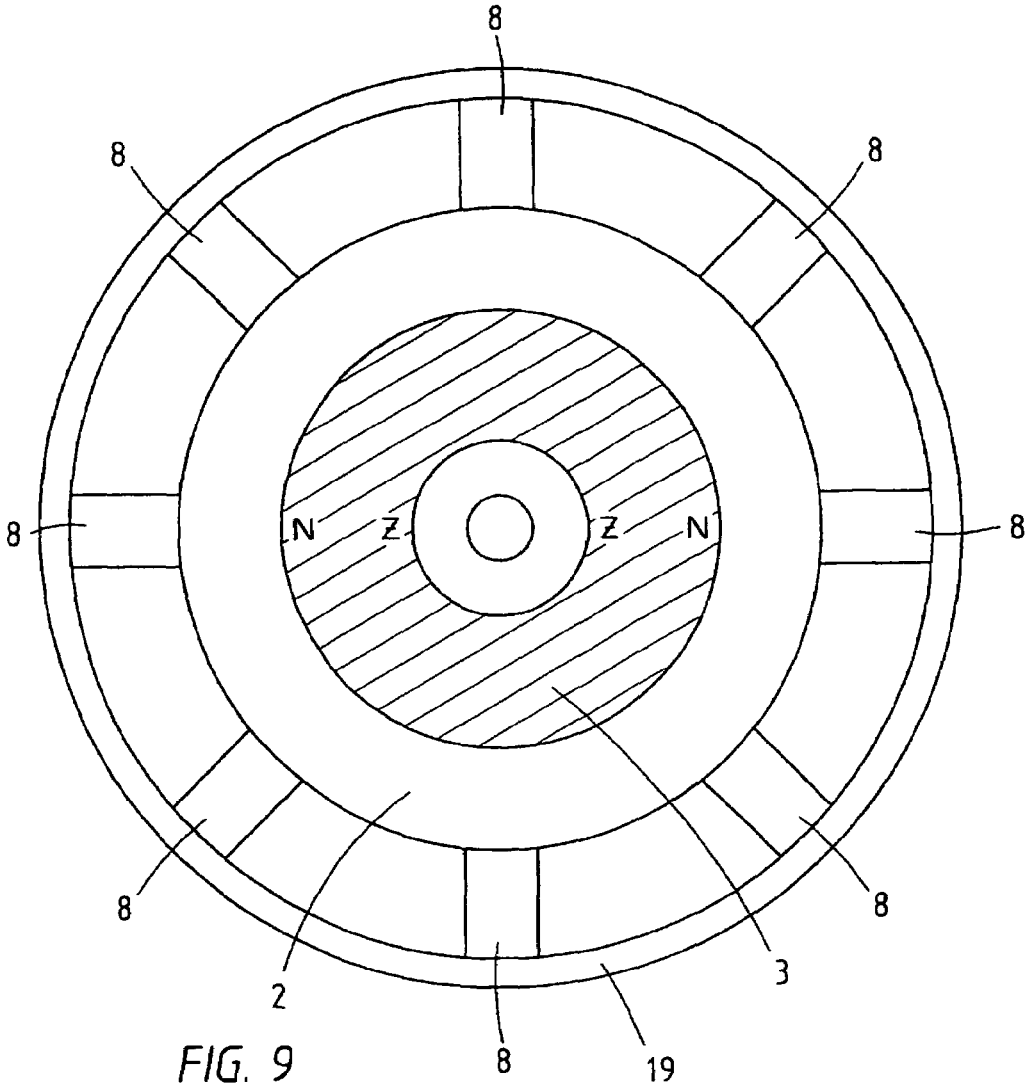
FIG. 9 shows an embodiment of the pump according to the invention having electromagnets according to FIG. 6*b*.

In FIG. 6*b* an embodiment is shown in which the annular magnet is radially magnetized. The electromagnets 8 have a soft iron core 9, which at one end 9*a* adjoins the actuator chamber 3. In FIG. 9, an actuator chamber 2 is shown with an actuator body 3 therein and provided with electromagnets 8 round about, as shown in FIG. 6*b*. The ends 9*a* of the soft iron cores 9 lie alongside the actuator chamber 2. The other pole 9*b* is connected to a soft iron ring 19. When, in this configuration, two electromagnets 8 are oppositely excited, so that the one attracts the actuator body 3 and the other repels the actuator body, then the field lines are conducted via the soft iron ring 19 from the end 9*b* of the one electromagnet 8 to the end 9*b* of the other electromagnet.

The inlet or outlet port 13 and 14 respectively of the pump chamber 4 is preferably provided with a non-return valve. This valve can be a magnetically operated valve which can be opened and closed by the application of a magnetic field. This is preferably the magnetic field which is generated by the electromagnet 8 mounted alongside the pump chamber 4 for the operation of the actuator body 3.

Figure 7:
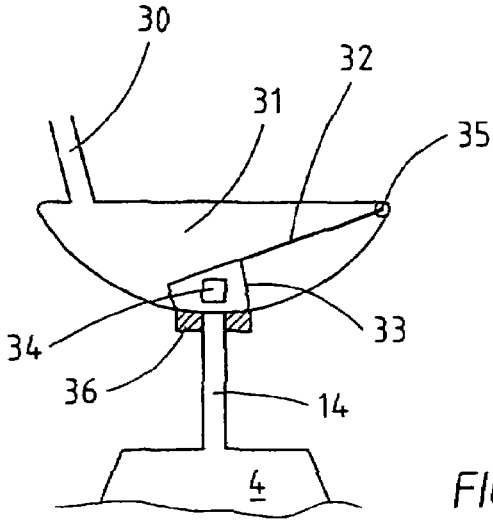
FIG. 7 shows an example of a magnetic non-return valve.

A non-return valve of this kind can be realized, for example, as shown in FIG. 7. From the pump chamber 4, fluid is pumped away via the outlet port 14 and a valve chamber 31 to a discharge pipe 30. In the valve chamber 31 there is a valve comprising an arm 32, which, at 35, is hinge-connected to the valve chamber 31. Attached to the free end of the arm 32 is a sealing body 33 for sealing the outlet port 14. In the sealing body 33 there is fitted a magnet 34, which reacts to the magnetic field of the electromagnet 8. During the pump stroke of the pump chamber 4, whereupon the electromagnet 8 is excited and the displacement member is moved from the first to the second position, the magnetic field of the electromagnet 8 pulls the magnet 34 away from the outlet port 14 and opens the valve so that the medium is conducted through the discharge pipe 30. Preferably, the region around the seat of the valve is provided with a magnetic or magnetizable element 36. This ensures that, when the electromagnet 8 is not excited, the sealing body 33 is attracted by the seat and the valve is kept closed.

Figure 12:
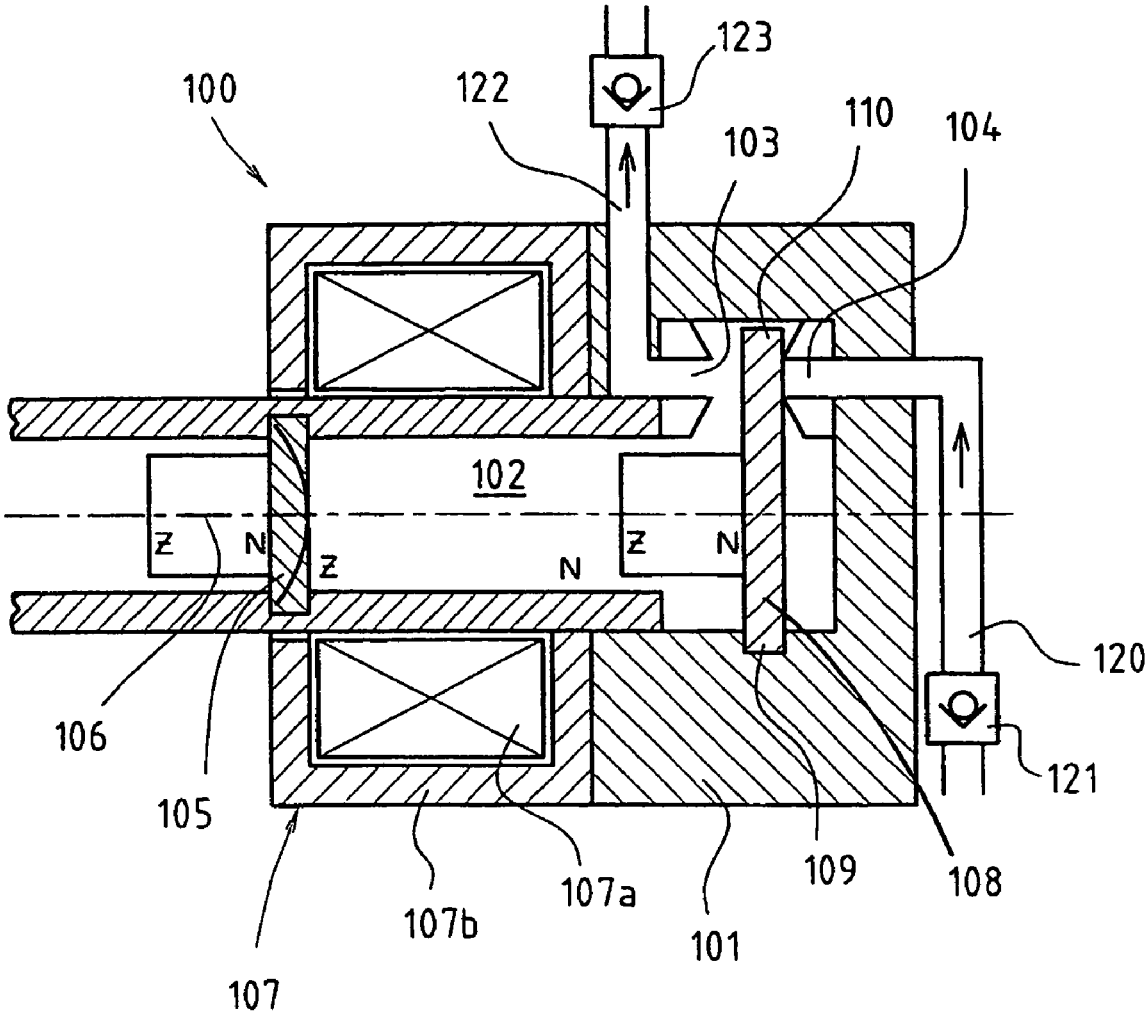
FIG. 12 shows a diagrammatic view in cross section of an embodiment of a pump according to the second aspect according to the invention.

In FIG. 12 another pump 100 is shown, having a housing 101 containing at least one pump chamber 102 provided with an inlet port 104 and an outlet port 103. The pump chamber 102 is delimited by a displacement member 105 in the form of a membrane connected to a magnetic element 106. The magnetic element 106 forms the actuator body of this pump 100 and has a north pole N and a south pole Z, as indicated in the figure. The displacement member 105 is movable to and fro between a first position, in which the pump chamber 102 has a maximum volume, and a second position, in which the pump chamber has a minimum volume. By "movable" is meant in this embodiment the convex or concave deformation of the membrane 105.

The pump 100 further comprises magnetic drive means in the form of an electromagnet 107 for creating a magnetic field in order to move the actuator body 106. The electromagnet 107 comprises a coil 107*a* and a soft iron yoke 107*b*. When, by the electromagnet 107, a field is created having a north pole N and a south pole Z, as indicated in FIG. 12, then the actuator body 106 is attracted by the electromagnet 107 and the membrane 105 will deform inwards, whereby the volume of the pump chamber 102 is diminished. If the electromagnet 107 is excited the other way round, then a reverse magnetic field is created, as indicated in FIG. 12, and the actuator body 106 is repelled, whereby the membrane 105 is concavely deformed and the volume of the pump chamber 102 is enlarged.

The pump chamber 102 is provided at the inlet port 104 and outlet port 103 with a valve 108, which is realized, for example, as a rubber flap which at one end 109 is fixed to the housing 101 and with the other end 110 can move between the inlet port 104 or the outlet port 103. The valve 108 is provided with a magnet 109, which reacts to the magnetic field created by excitation of the electromagnet 107. The valve 108 thus reacts to a magnetic field generated by the electromagnetic drive means, belonging to the pump chamber 102, for driving the actuator body 106. The valve 108 seals the inlet 104 during the pumping stroke of the displacement body 105, thus as the volume of the pump chamber 102 is reduced. The valve 108 seals the outlet 103 during the suction stroke of the displacement body 105, thus as the volume of the pump chamber 102 is enlarged. The fact that the valve 108 is operated by the magnetic field applied for the execution of a pumping stroke or a suction stroke means that the inlet port 104 and the outlet port 103 respectively are quickly closed once the end of the suction stroke and pumping stroke respectively is reached. Few pump losses are consequently incurred. This is especially favourable if the pump 100 is small in construction and is used to pump very small quantities of medium, as can be the case in medical applications. A pump of this kind, by virtue of the very small pump losses, allows for very accurate metering.

Figure 13:
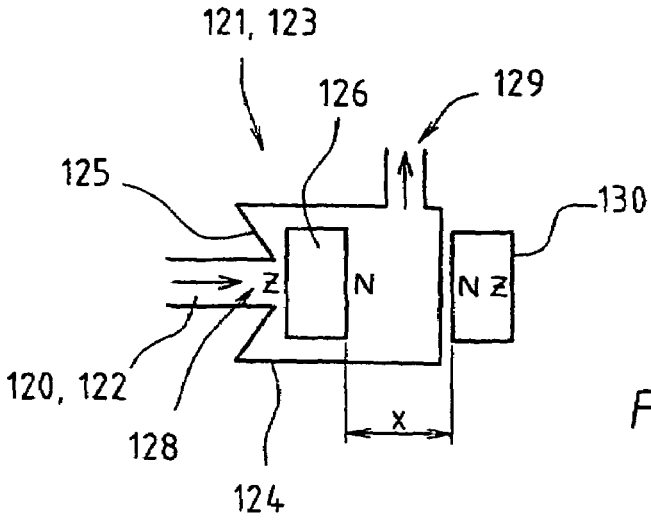
FIG. 13 shows in diagrammatic representation an embodiment of a non-return valve for the pump of FIG. 12, and FIGS. 14*a* and 14*b* show in diagrammatic representation an embodiment of a non-return valve for the pump of FIG. 12.

In FIG. 12, an inlet pipe 120 is connected to the inlet port 104, which inlet pipe is provided with a first non-return valve 121, which is represented diagrammatically. Connected to the outlet port 103 is an outlet pipe 122, which is provided with a second non-return valve 123. The non-return valves 121 and 123 can be differently realized. For example, spring-pretensioned non-return valves can be used. Preferably, a magnetic resetting means is used. In FIG. 13, an example of an embodiment of such a non-return valve 121, 123 is represented diagrammatically. The non-return valve 121, 123 comprises a valve housing 124 having a valve inlet 128 and a valve outlet 129.

In the valve housing 124 there is accommodated a magnetic closing member 126, which in the closed state of the valve bears against a valve seat 125. The closing member 126 has a north pole N and a south pole Z, as indicated in the figure. Attached to the valve housing 124 is a permanent magnet 130, which is polarized in such a way that this repels the closing member 126 in the direction of the valve seat 125. The distance x between the closing member 126 and the magnet 130 determines the force with which the magnet 130 repels the closing member 126 and hence the pretension with which the closing member 126 is pressed against the seat 125.

The pressure of a medium current through the valve inlet 128 must overcome the pretension in order to open the valve. By making the distance x adjustable, the pretension with which the valve is held in the sealed state is also adjustable.

In FIG. 14, a system of non-return valves 130 for the inlet pipe 120 and the outlet pipe 122 is shown. The valve system 130 comprises the first non-return valve 121 and the second non-return valve 123. The closing members 126 of the first non-return valve 121 and the second non-return valve 123 are polarized in such a way and the first non-return valve 121 and the second non-return valve 123 are positioned one relative to the other in such a way that the closing members 126 repel each other and are thus each pressed with the same pretension against their associated valve seat 125. In this illustrative embodiment, the first non-return valve 121 and the second non-return valve 123 are thus pretensioned by the same magnetic resetting means comprising two closing members 126.

Figure 14A:
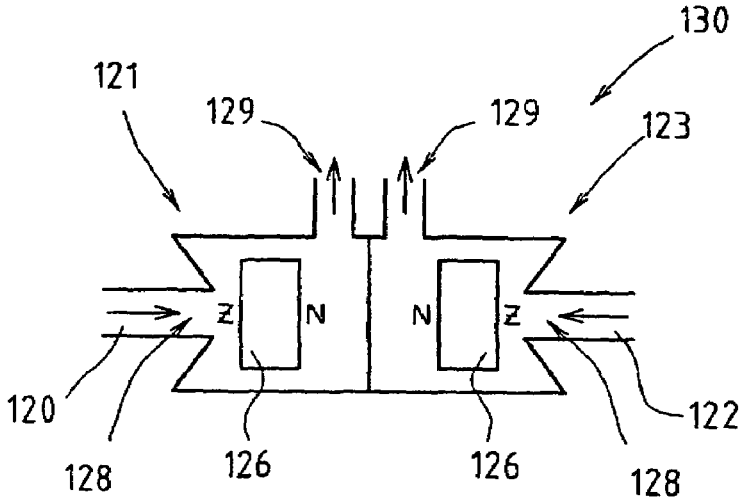
Figure 14B:
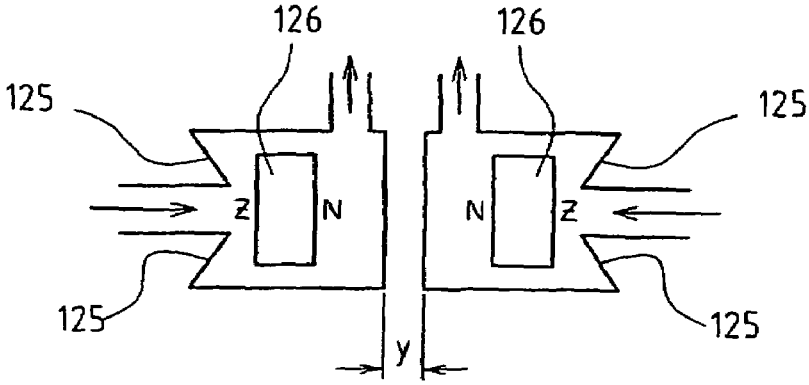

The first non-return valve 121 and the second non-return valve 123 can be placed one against the other, as shown in FIG. 14*a*, the pretension of both valves being maximal. By placing the non-return valves 121 and 123 at a distance y apart, as shown in FIG. 14*b*, the pretension can be reduced. By making the distance y adjustable, the pretension of the valves 121, 123 can be made adjustable.

The valves 121, 123, in the form as shown in FIG. 14, have the same pretension. If, for the first non-return valve 121, a lower pretension is desired than for the second non-return valve 123, then an element made of magnetic or magnetizable material, for example, can be fitted alongside the seat 125 of the first non-return valve 121, so that the closing member 126 is attracted and the pretension is reduced.

It should be noted that in FIG. 12 a non-limiting example is given of a pump according to the second aspect of the invention. It will be clear, for example, that a pump according to the first aspect of the invention, which is provided with a valve 32 as shown in FIG. 7, should also be regarded as an example of a pump according to the second aspect of the invention.

The invention claimed is:

1. Pump for pumping one or more media, comprising:

a housing having at least one pump chamber, which is provided with a port and which is delimited by a displacement member which is movable to and from between a first position and a second position, a movable actuator body, consisting of a magnetizable or magnetic material, for driving the displacement member, electromagnetic drive means for creating a magnetic field in order to move the actuator body, wherein the pump chamber, at the port, is provided with a magnetically operable valve comprising a magnetizable or magnetic material, which reacts directly to said magnetic field generated by the electromagnetic drive means, such that when the displacement member is driven from the first position to the second position, the magnetically operable valve at the port is driven by the magnetic field to a position in which the port is closed, and when the displacement member is driven from the second position to the first position, the magnetically operable valve at the inlet is driven by the magnetic field to a position in which the port is opened.

2. Pump according to claim 1, wherein the magnetically operable valve is provided at an inlet port of the pump chamber.

3. Pump according to claim 1, wherein the magnetically operable valve is provided at an outlet port of the pump chamber.

4. Pump according to claim 1, wherein one common magnetically operable valve is provided at an inlet and an outlet of the pump chamber.

5. Pump according to claim 1, wherein the pump chamber has an inlet port and an inlet pipe is connected to said inlet port, which inlet pipe is provided with a first non-return valve.

6. Pump according to claim 5, in which the first non-return valve is provided with a magnetic resetting means in order to keep the first non-return valve under pretension in a closed state.

7. Pump according to claim 5, wherein the pretension of the magnetic resetting means is adjustable.

8. Pump according to claim 1, wherein the pump chamber has an outlet port and an outlet pipe is connected to said outlet port, which outlet pipe is provided with a second non-return valve.

9. Pump according to claim 8, wherein the second non-return valve in the outlet pipe is provided with a magnetic resetting means in order to keep the second non-return valve under pretension in a closed state.

10. Pump according to claim 9, wherein both the first non-return valve and the second non-return valve are pretensioned by the same magnetic resetting means.

11. Pump according to claim 1, wherein the actuator body is freely movable relative to the displacement member so that the displacement member can be moved, by means of an impact motion of the actuator body, from the first to the second position.

* * * * *